US006647241B2

(12) United States Patent
Harashima

(10) Patent No.: US 6,647,241 B2
(45) Date of Patent: Nov. 11, 2003

(54) SHEET WRINKLING SUPPRESSION IMAGE FORMING APPARATUS AND METHOD

(75) Inventor: Yuichi Harashima, Yashio (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/184,913

(22) Filed: Jul. 1, 2002

(65) Prior Publication Data

US 2003/0016976 A1 Jan. 23, 2003

(30) Foreign Application Priority Data

Jun. 29, 2001 (JP) ..... 2001-198052
May 21, 2002 (JP) ..... 2002-15875

(51) Int. Cl.[7] ..... G03G 15/00
(52) U.S. Cl. ..... 399/389; 399/45
(58) Field of Search ..... 399/389, 396, 399/376, 388, 394, 45, 322, 75

(56) References Cited

U.S. PATENT DOCUMENTS 5,745,832 A * 4/1998 Yoshiuchi ..... 399/396
5,828,939 A * 10/1998 Yoshiuchi et al. ..... 399/388
2002/0076226 A1 * 6/2002 Ishimizu et al. ..... 399/45

FOREIGN PATENT DOCUMENTS

JP 11349214 A * 12/1999 ..... G03G/15/00

* cited by examiner

*Primary Examiner*—Fred L. Braun
(74) *Attorney, Agent, or Firm*—Oblon, Spivak, McClelland, Maier & Neustadt, P.C.

(57) ABSTRACT

An image forming apparatus includes a sheet feeding section for feeding a sheet, and a sheet transportation path defining a transportation path for the sheet fed by the sheet feeding section. An image formation section may be provided so as to form an image. The image formation section may include a photo-conductive member arranged in the sheet transportation path. A fixing section may be provided so as to fix a toner image transferred onto the sheet from the photo-conductive member with heating and pressure rollers. A sheet type recognition device may be provided so as to set information related to a sheet type that is selected by an operator. A sheet linear velocity control device may also be provided so as to change a sheet linear velocity of the feeding section in accordance with the sheet type in order to create relaxation of the sheet.

16 Claims, 3 Drawing Sheets

SHEET WRINKLING SUPPRESSION IMAGE FORMING APPARATUS AND METHOD

CROSS REFERENCE TO RELATED APPLICATIONS

This application claims priority under 35 USC §119 to Japanese Patent Application Nos. 2001-198052 and 2002-145875, respectively filed on Jun. 29, 2001 and May 21, 2002, the entire contents of which are herein incorporated by reference.

BACKGROUND OF THE INVENTION

1. Field of the Invention

The present invention relates to an image forming apparatus such a copier, a printer, a facsimile, etc and more particularly a sheet wrinkling supression image forming apparatus.

2. Discussion of the Background

Recently, an image forming apparatus employing an electro-photographic system is becoming more popular and is capable of forming images on various types of and sizes of sheets. In particular, an industrial image forming apparatus enables a user to copy on a polyester film and tracing paper which is a second master drawing in addition to a plain paper. Further, the industrial image forming apparatus occasionally utilizes a sheet larger than A0 size (JIS).

Many exemplary electro-photographic systems include a fixing station formed from a pair of heat and pressure applying rollers. However, an entire width of a tracing paper having weak rigidity is difficult to uniformly enter into a nip formed between the heat and pressure applying rollers. As a result, an amount of transportation deviation between widthwise left and right sides increases, and accordingly wrinkling easily arises. In the worst situation, the wrinkling occasionally reaches and affects a contacting portion (i.e., a transfer area) of the sheet that contacts a photo-conductive (PC) member located upstream.

Preventing such sheet wrinkling in the fixing station together with defective transfer is disclosed in Japanese Patent Laid Open No. 5-224548. Specifically, when a sheet carrying an image transferred from a PC member is conveyed by a void conveying apparatus to a nip formed between heat and pressure applying rollers, the void conveying apparatus is controlled to lose its conveyance force so that a tension can accordingly be applied to the sheet between the fixing station and void conveying apparatus. As a result, wrinkling of the sheet is avoided in the fixing station.

However, the inventor of the present invention realized a sensor for detecting passage of the sheet and for generating a detection signal on a sheet conveyance path in order to recognize a timing when the sheet is conveyed into the nip between heat and pressure applying rollers may be included. In addition, since a transfer and conveyance apparatus including the void conveyance apparatus is disposed between a pair of the heat and pressure applying rollers and PC member, the configuration is relatively complex and undesired cost increases occur. Further, a counter measure configured to minimize wrinkling caused by a difference in a sheet type is desired.

SUMMARY OF THE INVENTION

Accordingly, an object of the present invention is to address and to resolve the above-noted and other problems and provide a novel image forming apparatus.

The above and other objects are achieved according to the present invention by providing a novel image forming apparatus including a sheet feeding section for feeding a sheet, and a sheet transportation path defining a transportation path for the sheet fed from the sheet feeding section. An image formation section including a photo-conductive member arranged in the sheet transportation path may also be provided so as to form an image. A fixing section may be provided so as to fix a toner image transferred onto the sheet from the photo-conductive member with heat and pressure rollers, and a sheet type recognition device may be provided so as to set information related to a sheet type selected by an operator. A sheet linear velocity control device may also be provided so as to only change a sheet linear velocity of the feeding section in accordance with the sheet type.

In another embodiment, the sheet feeding section is driven by a separately employed motor, and sheet transportation series members including the photo-conductive member arranged on the sheet transportation path are driven by a commonly used motor.

In yet another embodiment, the sheet feeding linear velocity control device decreases a linear velocity of the sheet feeding section when a weak rigidity sheet is selected and set.

In still another embodiment, the sheet feeding linear velocity control device gradually increases and approximates the decreased linear velocity of the sheet feeding section to the previous linear velocity when a sheet length exceeds a prescribed value.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE PRESENT INVENTION

Figure 1:
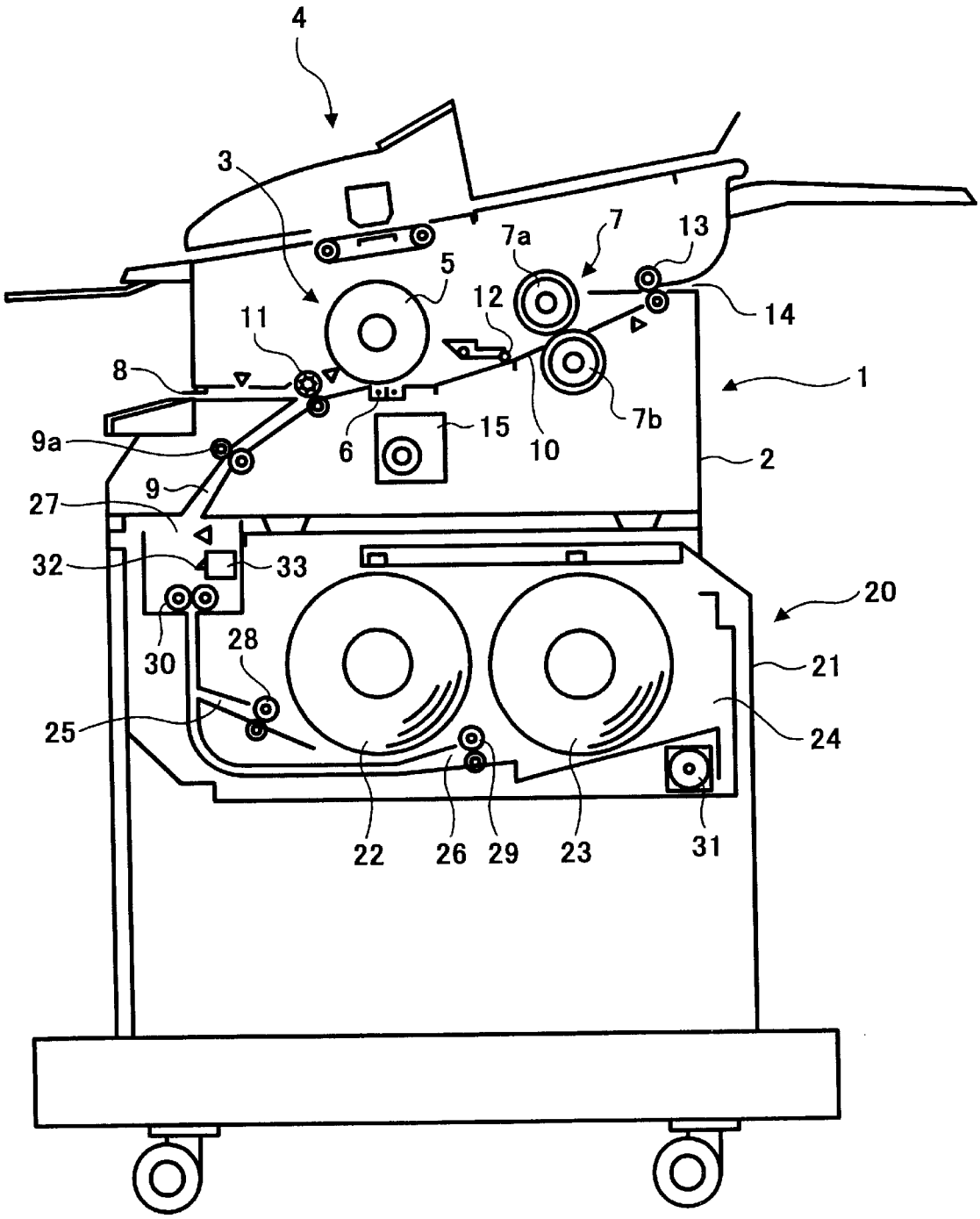
FIG. 1 is a schematic vertical cross sectional view illustrating an image forming apparatus as one embodiment of the present invention.

Referring now to the drawings, wherein like reference numerals and marks designate identical or corresponding parts throughout several figures, in particular, in FIG. 1, an image forming apparatus of one embodiment of the present invention is illustrated.

The image forming apparatus 1 is exemplified as a copier including an image formation section 3 inside a printer body 2 and optionally a manuscript reading apparatus 4 positioned above the image formation section 3. The image formation section 3 may have a configuration, well known by one skilled in the art, using an electro-photographic system. Specifically, the image formation section 3 may include various processing units (not shown), including but not limited to, discharging, latent image forming, developing, remaining toner cleaning, charge removing units around a photo-conductive (PC) member 5, and a transfer device 6 for transferring an image developed on the PC member 5 to a sheet. In addition, a fixing section 7 may be arranged downstream of the transfer device 6. The fixing section 7 may be formed from a heat roller 7*a* and pressure roller 7*b* pressure contacting the heat roller 7*a*.

A sheet-conveying path 10 with an upstream side connected to sheet feeding paths 8 and 9 may be arranged between the PC member 5 and transfer device 6. A conveying roller 9*a* may be arranged on the sheet-feeding path 9, and a register roller 11 may be arranged upstream of the PC member 5 on the sheet conveying path 10. Further, a roller 12 may be arranged upstream of the fixing station 7 so as to depress a sheet, and an ejection roller 13 may be arranged downstream of the fixing station 7. An ejection outlet 14 may be formed at a downstream end of the sheet-feeding path 10 so as to eject sheets onto an ejection tray (not shown). PC member 5, fixing station 7, register roller 11, and sheet ejection roller 13 may function as sheet conveying series members conveying a roll type sheet 22 or 23 which serves as a copysheet. Each of the respective PC member 5, heating roller 7*a* of the fixing station 7, register roller 11, and sheet ejection roller 13 may be driven when receiving rotational force from a commonly used conveyance motor 15 via a transmission apparatus (not shown). Further, the conveyance roller 9*a* on the sheet-feeding path 9 may be configured also to receive a rotational force from the conveyance motor 15.

Further, if the linear velocity of the PC member 5 and register roller 11 is V1, and the linear velocity of the fixing station 7 (i.e., heating roller 7*a*) is V2, V1 and V2 satisfy the equation:

$$V2>V1$$

such that relaxation and wrinkling of a roll sheet 22 or 23 which occur between the PC member 5 and heat roller 7*a*, depending upon its type, may be prevented. In a non-limiting example, the heat roller 7*a* may have a barrel shape with a central diameter which is slightly larger than that of the ends. The V1 and V2 may be slightly differently determined. Specifically, V1 and V2 may satisfy the equation:

$$V1\times1.002\leqq V2\leqq V1\times1.01$$

In addition, a sheet feeding apparatus 20 may be arranged below the printer body 2. A roll sheet accommodation section 24 may be formed in the sheet feeding apparatus body 21 of the roll sheet feeding apparatus 20 so as to accommodate a plurality of roll sheets 22 and 23. Also, a feeding sheet ejection outlet 27 may be formed to eject a sheet from the roll sheet accommodation section 24 to the sheet feeding passage 9 of the printer body 2 via the sheet feeding paths 25 and 26. Respective sheet feeding rollers 28 and 29 may be arranged in the vicinity of the inlets of the sheet conveyance passages 25 and 26 as a sheet feeding section. In addition, a transportation roller 30 may be arranged upstream and in the vicinity of the feeding sheet ejection outlet 27 as a feeding section. Rollers, such as sheet feeding rollers 28 and 29 and the transportation roller 30 may be driven while receiving rotational force from a commonly used feeding motor 31 via a transmission apparatus (not shown).

Further, a cutter 32 may be provided downstream and in the vicinity of the feeding sheet ejection outlet 27 so as to cut a roller sheet 22 or 23. Also, a carrier 33 may support the cutter 32. The cutter 32 may be configured to move together with the carrier 33 in the widthwise direction of the roll sheet 22 or 23, and cut the roll sheet 22 or 23 when driven during the movement.

Roll sheet 22 or 23 may be different types and are optionally selected by an operator. A sheet type recognition device may be provided so as to set a type of a roll sheet 22 or 23 when selected. Although not shown, the sheet type recognition device may be activated when a CPU determines a type of a key operated by a user when he or she selects a sheet type.

Alternatively, an indicator capable of indicating a mark in accordance with a type of the roll sheet 22 or 23 may be arranged in the roll sheet accommodating section 24 and may be configured to be read and recognized. Still otherwise, a type of the roll sheet 22 or 23 may automatically be detected, for example, by measuring a property of a roll sheet, such as but not limited to, rigidity, transmittance of a light, etc.

Sheet types in this embodiment may include, for example but not limited to, plain paper, film, and tracing paper. A length of a sheet may be determined when a cutter 32 cuts a roll sheet 22 or 23 into a prescribed length. However, information related to such a length may be recognized from an amount of duplicating data in a sub scanning direction (i.e., a sheet transportation direction), for example.

A sheet feeding linear velocity control operation is now described. The image forming apparatus 1 may include a microcomputer (not shown) including a CPU capable of recognizing information input through the operation key that allows setting of a type of the above-described roll sheets 22 or 23. In addition, the microcomputer may include a memory such as a RAM for temporary storing duplication data read by the manuscript reading apparatus 4. Further, the micro-computer may include a table defining an amount of a current to be carried through a sheet feeding motor 31 in accordance with a type of the above-described roll sheet 22 or 23 selected and set. The micro-computer may execute a program capable of changing a linear velocity of each of the sheet feeding roller 28 or 29 and transportation roller 30 by driving the sheet feeding motor 31 with a current set by the table, when a sheet is to be fed.

Further, the program may also control the linear velocity of the respective rollers 28 or 29 and transportation roller 30 to approximate the linear velocity V1 of the respective PC member 5 and register roller 11, when a type of paper with a sheet rigidity which is more than a prescribed reference value of rigidity (e.g. rigidity related to a plain paper or a film) is set. When a type of paper (e.g. the tracing paper) with a sheet rigidity property less than the prescribed reference value set, the linear velocity V1 of the sheet feeding rollers 28 or 29, and transportation roller 30 may be controlled to be a lower linear velocity of V3. In addition, the lowered linear velocity of the sheet feeding rollers 28 or 29, and the transportation roller 30 may gradually be accelerated so as to approximate the linear velocity of V1 when a sheet transportation length amount and exceeds a prescribed value of transportation length amount (e.g. 1200 mm distanced from a sheet feeding section in this embodiment). This is because, for example, when a roll sheet is continuously fed at the velocity V2 and a tension such that deformation excessively increases, defective transfer may arise after the prescribed value of transportation length amount is transported. Further, if the acceleration is promptly performed, the tension immediately disappears at a transfer section, thereby resulting in transfer image vibration. In addition, programming may be designed to maintain a previous speed and is not accelerated after the transportation length amounts and reaches a length of 1440 mm. The relation between V1 and V3 may be determined so as to satisfy the following relation:

$$V1\times0.986\leqq V3<V1$$

Specifically, V3 may vary and range from a linear velocity lower than V1 by 1% to 4% to less than V1.

In such a configuration, when a roll sheet 22 is selected, the roll sheet 22 may be fed by the sheet feeding rollers 28 and transportation roller 30 from the sheet feeding passage 25 to the sheet feeding passage 9 formed in the image forming apparatus 1. In contrast, when a roll sheet 23 is selected, the roll sheet 23 may be fed by the sheet feeding rollers 29 and transportation roller 30 toward the sheet feeding passage 9 of the image forming apparatus 1 through the sheet feeding passage 26. In the image forming apparatus 1, charging, latent image forming and developing may be performed by respective electro-photographing system processing units on the surface of the PC member 5. Then, a toner image on the PC member 5 may be transferred onto a roll sheet 22 or 23 by a transfer device 6. The roll sheet 22 or 23 receiving the toner image may be transported to a fixing section 7, and the toner image is fixed. The cutter 32 may cut the roll sheet 22 or 23 into a prescribed length. The cut sheet may then be ejected by the ejection roller 13 onto an ejection tray from an ejection outlet 14.

When feeding and duplicating operations are performed on a type of a roll sheet 22 or 23 with a rigidity which is relatively large, such as a plain paper, a film, etc., the respective linear velocity of the sheet feeding rollers 28 or 29 and transportation roller 30 may be controlled by the above-described sheet-feeding linear velocity control device so as to approximate the linear velocity V1 of the register roller 11. In contrast, when a type of a roll sheet 22 or 23 whose rigidity is relatively lower, such as a tracing paper, is set, the respective linear velocity of the rollers 28 or 29 and transportation roller 30 may be controlled so as to approximate the linear velocity V3 lower than V1.

As a result, when a weak rigidity sheet such as a tracing paper is selected and fed, wrinkling may be avoided at the fixing station 7, if respective linear velocity of the sheet feeding rollers 28 or 29 and transportation roller 30 are changed from V1 to V3 that is lower than V1 by 1 to 4%, and accordingly, a tension is applied to the roll sheet 22 or 23. Thus, defective transfer from the PC member 5 may be prevented.

Figure 2:
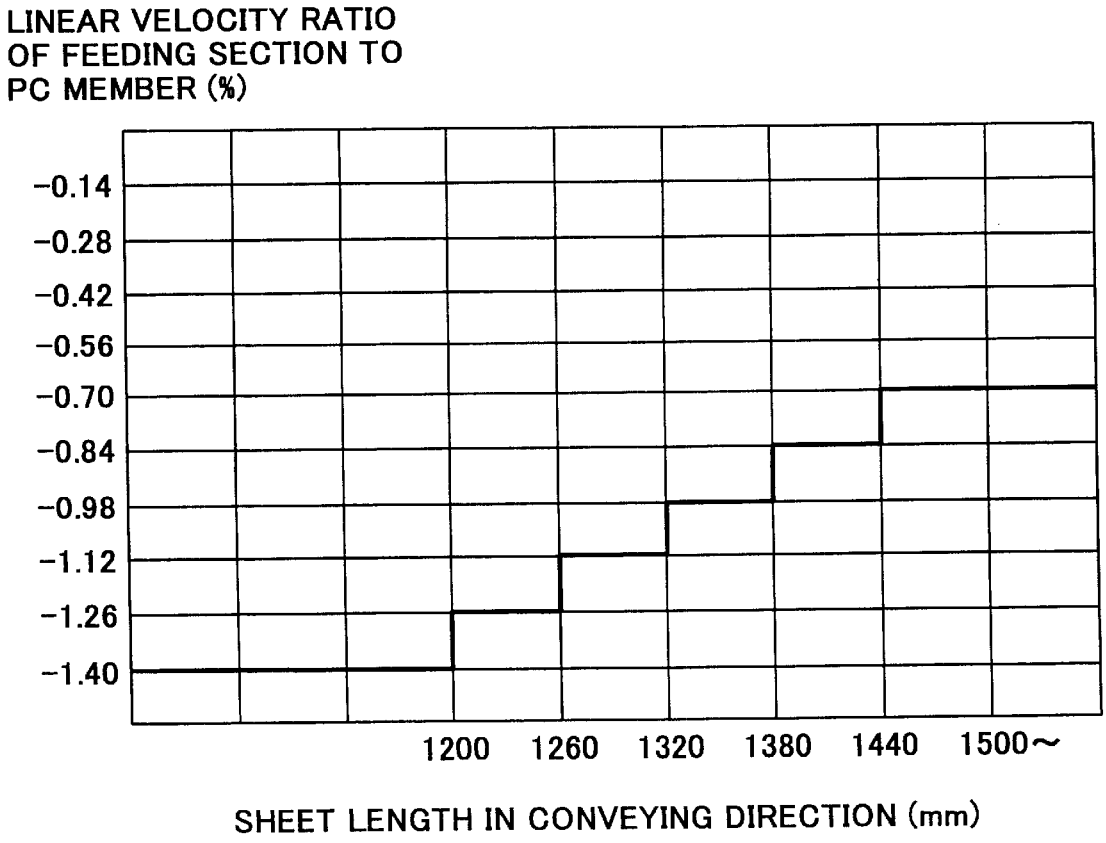
FIG. 2 is a graph illustrating a relation between a sheet transportation length and a linear velocity of a sheet feeding section.

FIG. 2 illustrates a relation between a sheet transportation length and a linear velocity of a sheet feeding section, in which the roll sheet transportation length (mm) is plotted on a horizontal axis and a ratio (%) of the sheet feeding section feeding velocity to the PC member transportation velocity is plotted on a vertical axis. Even though a tension can be applied to a weak rigidity roll sheet 22 or 23, since a total elongation amount is large when a length exceeds 1200 mm, a linear velocity may be increased step by step per 60 mm by 0% to 14% after 1200 mm is exceeded, so that the elongation amount can be suppressed within a prescribed level. However, even though such a week rigidity type is used, since respective linear velocity V3 of the feeding rollers 28 or 29 and transportation roller 30 should be maintained less than the V1, a previous linear velocity may be maintained and not exceeded, after the length reaches 1440 mm.

Accordingly, wrinkling may be suppressed in the fixing station even if a weak rigidity sheet is utilized, if a roll sheet is fed with a linear velocity V3 that is lower than V1 of the PC member 5 and register roller 11, and V2 of the fixing station 7, and a desirable tension is created by the roll sheet 22 or 23. Thus, a toner image can be appropriately transferred from the surface of the PC member 5.

Such an advantage may also be obtained, if a linear velocity of sheet feeding series members, such as a feeding roller 28, or 29, a transportation roller 30, etc., is constant, and a linear velocity of the fixing station 7 is changed in accordance with a sheet type. However, cost increases may occur due to a need of an additional motor for separately driving only a heat roller 7*a* in the fixing station 7.

However, according to the embodiment of the present invention, a roll sheet 22 or 23 may be employed as a sheet, and respective linear velocity of the sheet feeding roller 28 or 29 and transportation roller 30 may be increased immediately before the cutter 32 moves in a widthwise direction of the roll sheet 22 or 23 so as to cut the roll sheet 22 or 23. Thus, a sheet may be bent by a prescribed amount in a region downstream the cutter 32. Then, sheet feeding rollers 28 or 29 and transportation roller 30 may be stopped from rotating, and the cutter 32 may cut the roll sheet 22 or 23 while pinching it between secured and movable guide plates, respectively disposed along a moving direction of the cutter 32. Specifically, such a cutting method may be designed not to withdraw the roll sheet 22 or 23 from the PC member 5 at its upstream side. Thus, respective linear velocity of the sheet feeding rollers 28 or 29 and transportation roller 30 may be increased only for a period of time just before a cutting operation of the cutter 32.

Thus, the rollers 22 or 23 and transportation roller 30 for feeding a roll sheet 22 or 23 toward the PC member 5 may be driven by an independent sheet feeding motor 31, because a linear velocity should be increased just before the cutting operation for the roll sheet 22 or 23. Therefore, even if the respective linear velocities of sheet feeding rollers 28 or 29 and transportation roller 30 are required to be controlled to decrease in accordance with a sheet type, a cost increase may not be avoided.

In addition, since the commonly used transportation motor 15 drives, for example, the PC member 5, heating roller 7*a,* register roller 11, and ejection roller 13, arranged along sheet transportation path 10, a number of required motors may be decreased, and accordingly, a space adjacent to an image forming section may be minimized.

Figure 3:
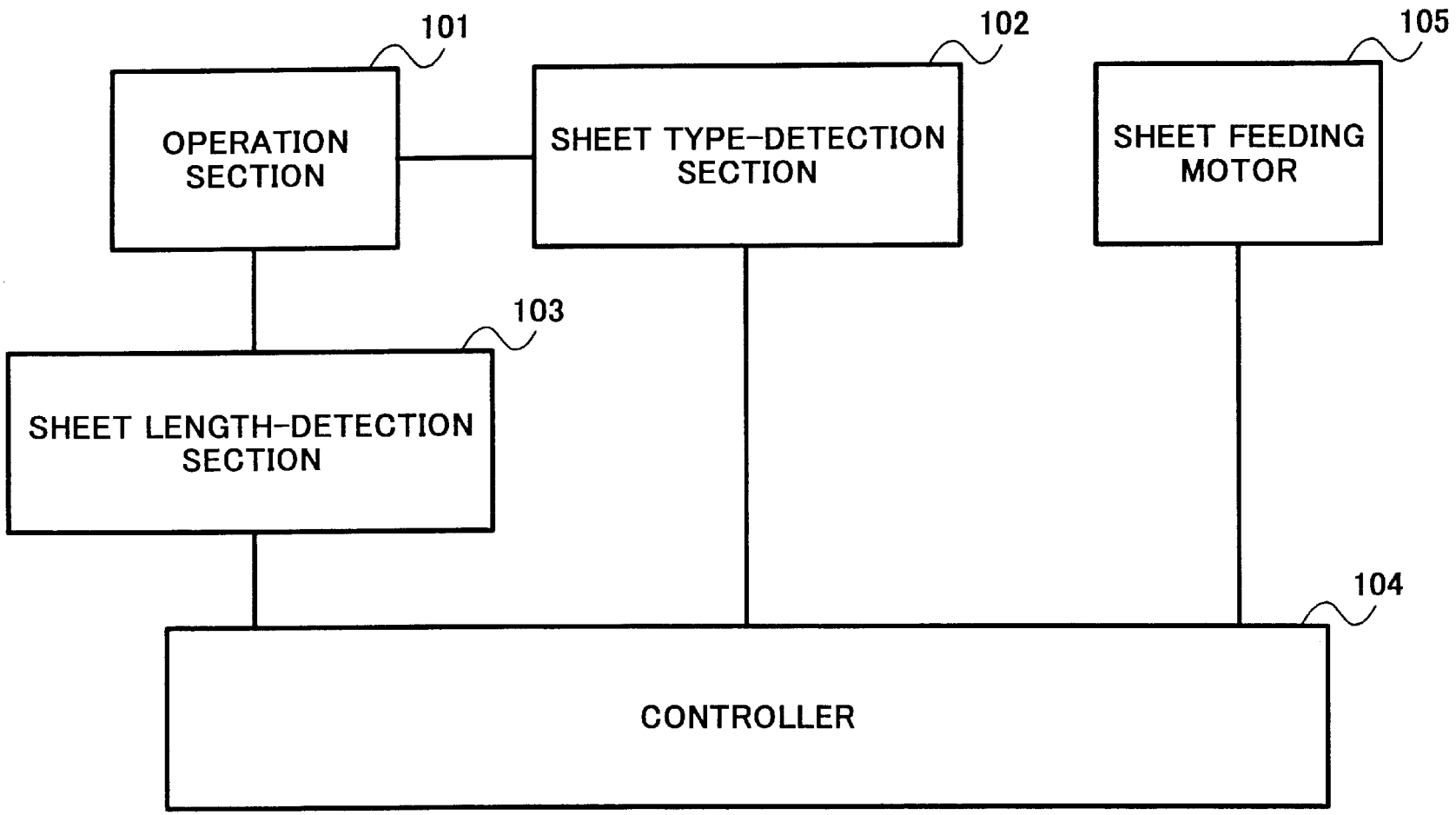
FIG. 3 is a block diagram illustrating a control system of the present invention.

FIG. 3 is a block diagram illustrating a controller 104 associated with the sheet length-detection section 103, operation section 101, sheet type-detection section 102 and sheet feeding motor 105.

The mechanisms and processes set forth in the present invention may be implemented using one or more conventional general purpose microprocessors and/or signal processors programmed according to the teachings of the present invention as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention therefore includes a computer-based product which may be hosted on a storage medium and include, but is not limited to, any type of disk including floppy disks, optical disks, CD-ROMs, magnet-optical disks, ROMs, RAMs, EPROMs, EEPROMs, flash memory, magnetic or optical cards, or any type of media suitable for storing electronic instructions.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United conditions is:

1. An image forming apparatus, comprising:

an image formation section configured to form a toner image on a photo-conductive member to be transferred onto a sheet;

a sheet feeding section configured to feed the sheet;

a sheet transportation series configured to transport downstream the sheet fed from the sheet feeding section;

a fixing section configured to fix the toner image transferred onto the sheet with heat and pressure rollers;

a sheet type recognition device configured to recognize and to generate sheet type information; and a sheet feeding linear velocity control device configured to relatively change a sheet feeding linear velocity of the sheet feeding section based on the sheet type information.

2. The image forming apparatus according to claim 1, said sheet feeding linear velocity control device changes the sheet feeding linear velocity of the sheet feeding section while maintaining linear velocities of the image forming section, sheet transportation series and fixing section.

3. The image forming apparatus according to claim 2, wherein said sheet feeding section is driven by a first motor, and said sheet transportation series and the photo-conductive member are driven by a second motor.

4. The image forming apparatus according to claim 1, wherein said sheet feeding linear velocity control device decreases a linear velocity of the sheet feeding section when the sheet type information is related to a weak rigidity sheet.

5. The image forming apparatus according to claim 4, wherein said sheet feeding linear velocity control device gradually increases the decreased linear velocity and approximates a previous linear velocity when a sheet is fed and its length distanced from the sheet feeding section exceeds a prescribed value.

6. The image forming apparatus according to claim 5, wherein said prescribed value is about 1200 mm.

7. The image forming apparatus according to claim 6, wherein said previous linear velocity is less than a linear velocity of the photo-conductive member.

8. The image forming apparatus according to claim 5, wherein said previous linear velocity is less than a linear velocity of the photo-conductive member.

9. A method for forming an image on a sheet, comprising:

recognizing a type of the sheet;

feeding a sheet from a sheet feeding section at a prescribed sheet feeding linear velocity;

forming a toner image on a photo-conductive member;

transferring the toner image onto the sheet;

transporting the sheet downstream;

fixing the toner image onto the sheet with heat and pressure rollers; and decreasing the sheet feeding linear velocity of the feeding section in accordance with the sheet type while maintaining linear velocities of the photo-conductive member, sheet transportation and heat and pressure rollers.

10. The method of claim 9, further comprising gradually increasing the decreased linear velocity of the sheet feeding section and approximating a previous linear velocity when a sheet length distanced from the sheet feeding section exceeds a prescribed value.

11. An image forming apparatus, comprising:

means for feeding a sheet at a prescribed sheet feeding velocity;

means for recognizing a sheet type selected by an operator;

means for forming a toner image on a photo-conductive member;

means for transferring the toner image from the photo-conductive member onto the sheet;

means for transporting the sheet downstream;

means for fixing the toner image to the sheet with heat and pressure rollers; and means for changing a sheet linear velocity of the feeding section in accordance with the sheet type while maintaining linear velocities of the photo-conductive member, sheet transportation and fixing means.

12. The image forming apparatus, according to claim 11, wherein said sheet feeding linear velocity changing means decreases a linear velocity of the sheet feeding means when a weak rigidity sheet is set.

13. The image forming apparatus, according to claim 12, wherein said sheet feeding linear velocity changing means gradually increases the lowered linear velocity of the sheet feeding means and approximates a previous linear velocity when a sheet length distanced from the sheet feeding section exceeds a prescribed value.

14. The image forming apparatus according to claim 13, wherein said prescribed value is about 1200 mm.

15. The image forming apparatus according to claim 13, wherein said previous linear velocity is less than a linear velocity of the toner image forming means.

16. The image forming apparatus according to claim 14, wherein said previous linear velocity is less than a linear velocity of the toner image forming means.

* * * * *

UNITED STATES PATENT AND TRADEMARK OFFICE

CERTIFICATE OF CORRECTION

PATENT NO. : 6,647,241 B2
DATED : November 11, 2003
INVENTOR(S) : Harashima

It is certified that error appears in the above-identified patent and that said Letters Patent is hereby corrected as shown below:

Title page,
Item [30], Foreign Application Priority Data, should read:
[30] Foreign Application Priority Data
-- Jun. 29, 2001 (JP)……..2001-198052
May 21, 2002 (JP)……..2002-145875 --

Signed and Sealed this

Sixth Day of April, 2004

JON W. DUDAS
*Acting Director of the United States Patent and Trademark Office*